US005599094A

United States Patent [19]

Fischer et al.

[11] Patent Number: 5,599,094

[45] Date of Patent: Feb. 4, 1997

[54] MOUNTING SYSTEM FOR LIGHT FIXTURE

[75] Inventors: Jerry F. Fischer, West Chester; Robert E. Kaeser, Cincinnati; James E. Lawrence, Madeira, all of Ohio

[73] Assignee: LSI Industries, Inc., Cincinnati, Ohio

[21] Appl. No.: 533,980

[22] Filed: Sep. 26, 1995

[51] Int. Cl.[6] ..... F21S 1/12

[52] U.S. Cl. ..... 362/414; 362/431; 362/226; 285/178; 403/229; 411/17

[58] Field of Search ..... 362/414, 431, 362/226; 285/178, 391, 392; 403/229, 343; 411/16, 17, 18

[56] References Cited

U.S. PATENT DOCUMENTS

| | | | |
|---|---|---|---|
| 806,406 | 12/1905 | Farrington | 411/17 |
| 965,841 | 7/1910 | Andersen . | |
| 977,709 | 12/1910 | Craig . | |
| 1,175,662 | 3/1916 | Raeger . | |
| 1,199,624 | 9/1916 | Smith, Jr. . | |
| 1,830,919 | 11/1931 | Sundh . | |
| 1,830,920 | 11/1931 | Sundh . | |
| 1,906,508 | 5/1933 | Arbogast . | |
| 1,966,520 | 7/1934 | Rayner . | |
| 2,062,290 | 12/1936 | Bott . | |
| 2,623,085 | 12/1952 | Gier, Jr. . | |
| 2,649,830 | 8/1953 | Arnold . | |
| 2,712,742 | 7/1955 | Neidhart . | |
| 2,775,992 | 1/1957 | Smith . | |
| 2,890,072 | 6/1959 | Kaman et al. . | |
| 2,936,625 | 5/1960 | Heiseler . | |
| 3,008,742 | 11/1961 | Goldstein . | |
| 3,143,366 | 8/1964 | Nichols . | |
| 3,302,509 | 2/1967 | Modrey . | |
| 3,317,723 | 5/1967 | Reinhardt . | |
| 3,390,711 | 7/1968 | Wilcox . | |
| 3,517,184 | 6/1970 | Norton et al. . | |
| 3,532,369 | 10/1970 | Reilly . | |
| 3,599,692 | 8/1971 | Holmes . | |
| 3,790,292 | 2/1974 | Nestor . | |
| 3,885,648 | 5/1975 | Beziat . | |
| 3,945,070 | 3/1976 | Hauser . | |
| 3,967,525 | 7/1976 | Lerich . | |
| 3,983,736 | 10/1976 | King, Jr. . | |
| 4,238,818 | 12/1980 | Gindel . | |
| 4,309,135 | 1/1982 | Gutshall | 411/17 |
| 4,362,420 | 12/1982 | Van der Veken . | |
| 4,449,170 | 5/1984 | Warshawsky | 362/414 |
| 4,536,115 | 8/1985 | Helderman . | |
| 4,653,142 | 3/1987 | Upton . | |
| 4,712,955 | 12/1987 | Reece et al. . | |
| 4,770,560 | 9/1988 | Ott . | |
| 4,784,555 | 11/1988 | Cantrell . | |
| 4,832,550 | 5/1989 | Nilsson . | |
| 4,858,877 | 8/1989 | Carter . | |
| 5,006,023 | 4/1991 | Kaplan . | |
| 5,108,215 | 4/1992 | Hassid et al. . | |
| 5,284,399 | 2/1994 | Brüstle et al. . | |
| 5,295,057 | 3/1994 | Buonsante et al. . | |
| 5,339,229 | 8/1994 | Snyder . | |
| 5,356,183 | 10/1994 | Cole . | |

FOREIGN PATENT DOCUMENTS

| | | |
|---|---|---|
| 152336 | 10/1920 | United Kingdom . |
| 1202183 | 8/1970 | United Kingdom . |

*Primary Examiner*—Ira S. Lazarus
*Assistant Examiner*—Alfred Basichas
*Attorney, Agent, or Firm*—Wood, Herron & Evans, P.L.L.

[57] ABSTRACT

A mounting system for luminaire assemblies includes a mounting fixture which can be inserted into a tubular pole and secured therein without the need for complicated fasteners or tools. Specifically, the mounting fixture includes a cylindrical fitting with a tapered threaded section in which the depth of the groove forming the threads decreases upwardly along the fitting. A generally circular wire clip is seated within the tapered groove and upon rotation of the fitting relative to the tubular pole an end or detent of the clip engages the inner surface of the pole thereby prevent rotation of the clip. Continued rotation of the fitting relative to the pole advances the clip upwardly in the threaded section toward the more shallow portions of the groove thereby forming a friction fit between the expanding clip, the mounting fixture and the pole. The friction fit minimizes wobble, noise or other vibration between the assembled components and can be released upon reverse rotation of the mounting fixture relative to the pole. Furthermore, the pole may be of any polygonal or circular cross-sectional configuration as is desired.

20 Claims, 2 Drawing Sheets

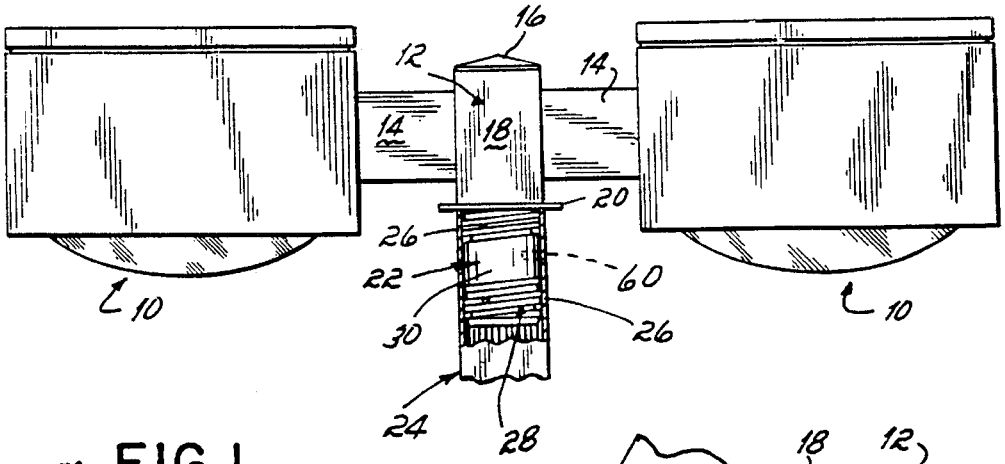
FIG. 1
FIG. 6
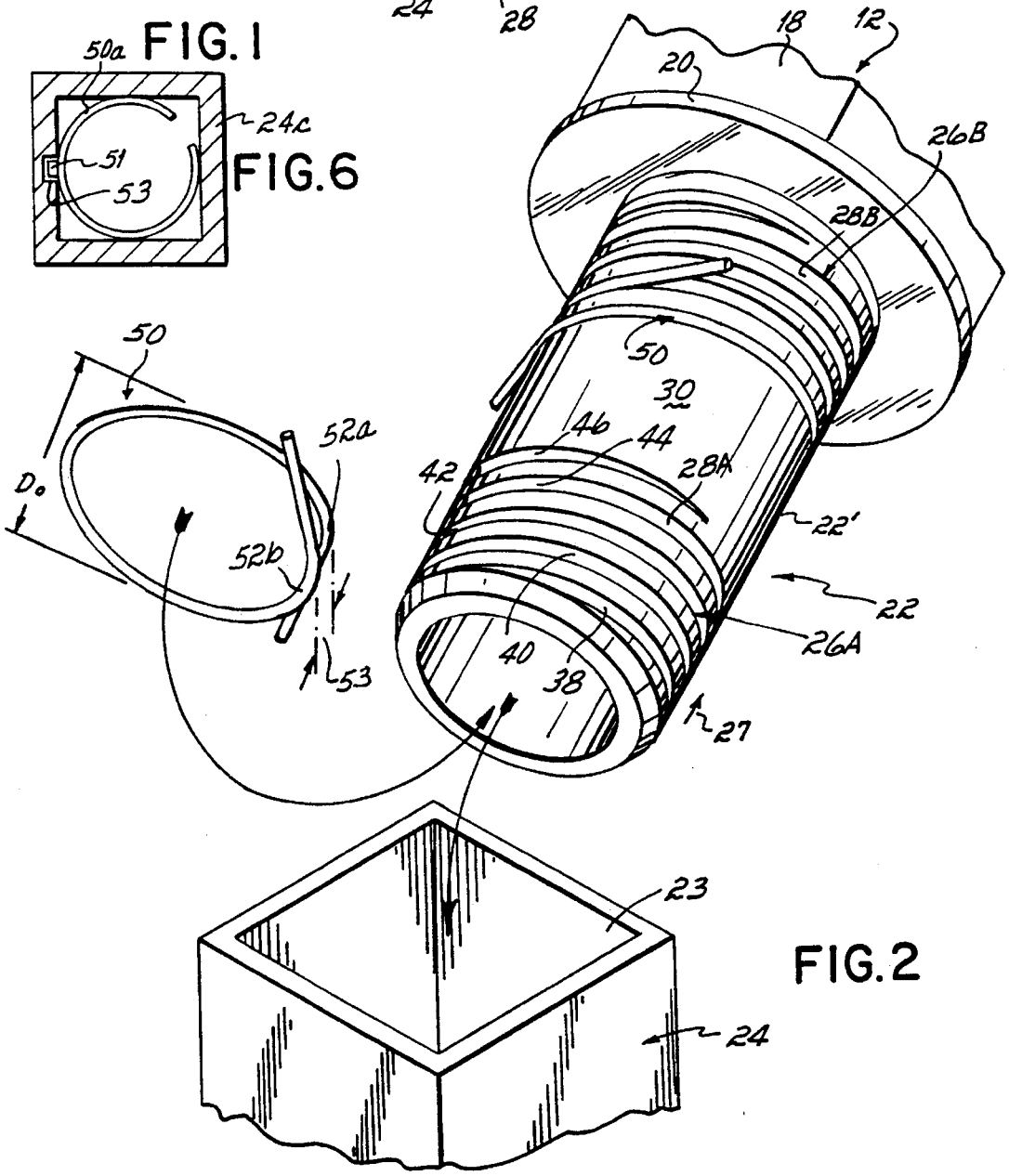
FIG. 2

MOUNTING SYSTEM FOR LIGHT FIXTURE

BACKGROUND OF THE INVENTION

This invention relates to pole-mounted luminaires and more particularly to a mounting system for easily and securely mounting luminaires to a pole.

Exterior luminaires used for lighting paths, sidewalks, parking lots or the like are typically secured to a tubular post or pole which extends vertically upward from the ground. Typically, a number of luminaires are secured to the top end of the post to provide area lighting for the parking lot, path, sidewalk or the like. The luminaire assemblies must be securely mounted to the top of the pole so as to resist vibration, movement, or twisting caused by the wind or other forces over a long period of time.

In the past, each luminaire assembly has been attached to a mounting fixture which is then inserted axially into the open top end of the tubular pole. Thereafter, a pair of holes is drilled by the installer transversely, that is, diametrically, through both the sidewalls of the tubular pole and the mounting fixture which is inserted therein. Bolts are then inserted through the holes and anchored in place by nuts or other mechanical fasteners to secure the luminaire assembly to the pole and prevent twisting thereof relative to the pole.

One problem associated with this prior system is that the mounting fixture which is inserted into the top of the tubular pole must have clearance to facilitate insertion. This clearance permits the mounting fixture to vibrate within the pole in response to wind-induced vibration of the luminaires. Due to manufacturing variations in the pole and mounting fixture, the actual size of the opening in the tubular pole varies substantially from the nominal or design dimension. Therefore, the difference between the size of the mounting fixture and the pole must include a margin of error or safety factor to ensure that the mounting fixture will fit inside any given nominal size pole and thereby minimize adjustments required by the installer. As a result of this arrangement, the bolts extending through the pole and mounting fixture do not dampen the vibration and the resulting noise which is generated by the luminaries. In addition to creating noise, the vibration of the mounting fixture causes it to become loose relative to the pole, resulting in the need for frequent repair and/or replacement and/or damage to the luminaire assembly.

Another problem with the prior mounting system is that it requires several different tools and a considerable amount of work and time to complete the installation. Further, complicating the installation procedure for luminaire assemblies is that the luminaire assemblies are typically installed on the pole after the pole is mounted in the ground, thereby requiring the installation procedure to be performed high above the ground. This presents potentially dangerous and difficult working conditions that make the installation of the luminaire assemblies even more difficult and time consuming.

SUMMARY OF THE INVENTION

It has therefore been a primary objective of this invention to provide a mounting system for securely attaching luminaire assemblies to the top of a vertically extending pole, which permits the mounting procedure to be easily accomplished on the ground prior to erecting the pole or atop the pole after it is erected.

It has been a further objective of the invention to provide such a luminaire mounting system which reduces or eliminates vibrations and thereby eliminates tilt and wobble of the installed luminaire.

It has been a still further objective of this invention to provide such a luminaire mounting system which can be accomplished without tools or complicated procedures and adjusted even after the installation has been accomplished in order to aim the luminaires for best coverage of illumination and achieve improved aesthetics with the surrounding structures and features of the environment.

It has been a still further objective of this invention to provide such a luminaire mounting system which permits the mounted luminaire to be easily removed for repair or service and then readily reinstalled.

It has been a still further objective to provide a luminaire mounting system which includes a very high degree of adjustability to account for variations in the nominal sizes of the components without significant modifications or large inventories of components.

The foregoing and other objectives of the invention have been attained by utilizing a mounting fixture which includes a generally cylindrical fitting on a lower end thereof which can be inserted axially into the open upper end cavity of the tubular pole. At least one, and preferably a pair of axially spaced spiral grooves are formed on the outer surface of the fitting, with each groove producing a threaded section on the fitting. The depth of each spiral groove decreases upwardly along the longitudinal axis of the fitting; however, the outer diameter of the cylindrical fitting is preferably constant. A generally circular wire clip is seated within each of the grooves on the fitting. Initially, each clip is positioned in the lower and deeper portions of its respective spiral groove, which may be accomplished at the factory. The outer diameter of the clips when located in the lower/deeper portion of their associated spiral groove is less than the inner dimension of the pole cavity providing for easy insertion of the fitting and associated clips into the pole cavity.

After the fitting and wire clips are inserted axially into the pole cavity, the fitting is rotated relative to the pole. A first terminal end of each wire clip projects outwardly from the clip and upon rotation of the fitting relative to the pole and clip, the end of each clip engages or abuts against the inner wall or surface of the cavity in the tubular pole. Once the end of each clip engages the cavity wall, each clip is inhibited from further rotating relative to the pole so that continued rotation of the fitting forces the clips to advance upwardly along their associated varying-depth grooves.

As the clips advance upwardly in their respective grooves, they progress from the deeper portions of their grooves to the shallow portions of their grooves, thereby expanding the clips outwardly and increasing their diameters until the outer surfaces of the clips contact the inside of the pole cavity. After the clips expand and contact the inside of the pole cavity, a friction fit is established between the fitting and the pole thereby securing the mounting fixture to the pole and eliminating clearance-associated vibration problems between the mounting fixture and the pole. Further, the almost infinite adjustments which are available with this system account for variations in the nominal sizes of the components due to manufacturing differences or the like without requiring a large inventory of components. In other words, a given size mounting fixture and fitting can be use with a range of nominal pole sizes and variations in those sizes. As a result, movement of the luminaire assembly by wind-induced vibration effects or the like is minimized and installation or replacement of existing light fixtures is greatly simplified.

After the mounting fixture is secured to the pole as described, a small hole can be drilled through the sidewall of the pole and into the fitting for the insertion of a pin or other fastener to rotationally lock the mounting fixture in position and prevent further rotation thereof relative to the pole. Advantageously, the mounting fixture could be secured to the pole and the luminaire assembly mounted to the mounting fixture on the ground thereby avoiding the need for the installer to attach the luminaire to the pole high above the parking lot or the like.

The mounting fixture can be removed from the pole after installation, as required, for repair or the like, by removing the locking pin or fastener from the pole and fitting, and then rotating the mounting fixture in a direction opposite to that required for installing the mounting fixture. A second end of each clip contacts another portion of the inner surface of the pole cavity upon reverse rotation, thereby preventing further rotation of the clips relative to the pole and fitting. Continued reverse rotation of the fitting advances the clips downwardly along their respective spiral grooves from the shallow to the deeper portions of their grooves, thereby diametrically contracting the clips and releasing the friction fit between the fitting/clips and the pole. As a result, the mounting fixture with associated luminaire can be removed from the pole, as required, and then reinstalled, without complicated tooling or extensive down-time.

An important feature of the present invention is that the mounting fixture can be used with poles having cavities with cross-sectional configurations of any shape, whether polygonal or circular. Preferably, a point is formed on the ends of the clip for application in a circular cross-section pole so that the ends more easily grip and engage the inner surface of the circular cross-section pole as opposed to merely abutting against a planar surface or sidewall of a polygonal cross-section pole.

It will be appreciated that the present invention provides a savings in installation, adjustment and repair time, cost and labor over known mounting systems for luminaire assemblies. Further, a minimal number of tools are required for the installation, adjustment and/or removal of the luminaire assemblies. Further, the invention provides secure and positive positioning of the luminaires and elimination of vibration and unwanted movement in response to wind effects and the like.

BRIEF DESCRIPTION OF THE DRAWINGS

The objectives and features of the invention will become more readily apparent from the following detailed description taken in conjunction with the accompanying drawings in which:

FIG. 1 is a side elevational view showing a mounting fixture secured to a light pole with luminaire assemblies attached to the mounting fixture and a portion of the pole broken away showing a fitting integral with the mounting fixture inserted into a cavity at the end of the tubular pole;

FIG. 2 is an enlarged perspective view showing the application of the wire clip to the fitting and the insertion of the fitting into the cavity in the upper end of the pole;

FIG. 6 is an enlarged cross-sectional view of another alternative embodiment of this invention.

DETAILED DESCRIPTION OF THE INVENTION

Figure 3:
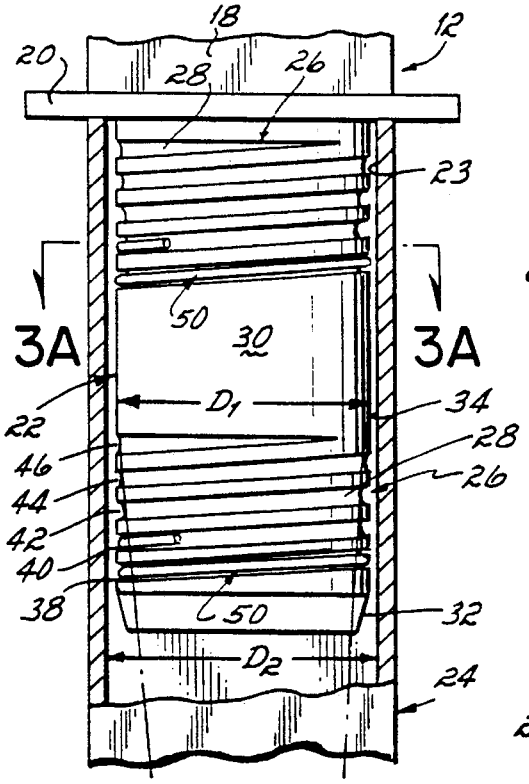
FIGS. 3 and 3A are cross-sectional views of the fitting being inserted within the pole.

Referring to FIG. 1, a presently preferred embodiment of the invention is shown and includes luminaire assemblies 10 secured to an upper portion of a mounting fixture 12. It will be appreciated by one of ordinary skill in the art that the luminaire assemblies 10 may be of any design and style and may include incandescent, fluorescent, high intensity discharge (HID) or any other type and style of mounting fixture. The luminaire assemblies 10 are connected to the mounting fixture 12 by a mounting arm 14 and appropriate fasteners (not shown) and an upper open end of the mounting fixture is closed by a snap-in cap 16.

As shown in FIGS. 1 and 2, an upper portion 18 of the mounting fixture 12 according to a presently preferred embodiment of the invention is square and includes an outwardly extending flange 20 separating the upper portion 18 from a fitting 22 on the lower portion of the mounting fixture 12. The fitting 22 is inserted into a cavity 23 at the open upper end of a tubular pole 24 which may be ground supported or the like (not shown) according to a presently preferred embodiment of the invention. The fitting 22 on the lower end of the mounting fixture 12 is preferably hollow and generally cylindrical and includes upper and lower threaded sections 26A and 26B comprising spiral grooves 28A and 28B formed in the outer surface 22' of the fitting 22. The upper and lower threaded sections 26A and 26B are spaced on either side of a smooth middle cylindrical section 30 of the fitting 22. The lowermost end of the fitting 22 includes an inwardly tapered lip 32. The end of the fitting 22 is open to its hollow interior. The fitting 22 may, of course, be solid in which event it would not have a hollow interior. As shown particularly in FIG. 3, an outer diameter $D_1$ of the fitting 22 is less than the inner dimension $D_2$ of the inside of the cavity 23 in the tubular pole 24 thereby providing a gap 34 between the fitting 22 and the inside surface of the pole 24 around the circumference of the fitting 22.

Figure 4:
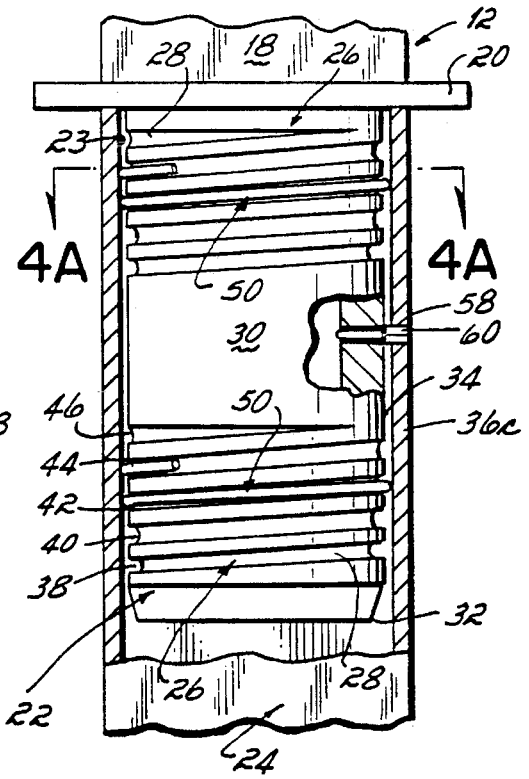
FIGS. 4 and 4A are cross-sectional views similar to FIGS. 3 and 3A but with the fitting being secured within the pole.

The threaded sections 26A and 26B are similar to one another and therefore will be described together herein. The spiral groove 28 forming each threaded section 26 is gradually tapered such that the depth of the groove 28 at a lower end of each threaded section 26 is greater than the depth of the groove 28 proximate the upper end of each threaded section 26 (FIGS. 3 and 4). Stated differently, each spiral groove has a continuously varying depth which decreases as it advances upwardly along the spiral groove in the direction of arrow 27 (FIG. 2) from the lower end to the upper end of each threaded section. In a presently preferred embodiment, the mounting fixture 12 is 15.625 inches in length and the upper square portion 18 measures 4 inches on each exterior side face. The outer diameter $D_1$ of the cylindrical fitting 22 of the mounting fixture 12 is 3.557 inches. In a presently preferred embodiment, the tubular pole 24 is square and has an outer dimension of 4 inches on each side 36*a*, 36*b*, 36*c*, 36*d* and a wall thickness of 0.120 inches (11 gauge) thereby yielding a cavity width of 3.76 inches for each dimension. Alternatively, the 4 inch outer dimension square pole 24 may have a wall thickness of 0.180 inches (7 gauge) and a cavity width of 3.64 inches. Due to the design of the variable depth groove 28, the mounting fixture 12 according to this invention can accommodate a range of pole 24 sizes with continuous adjustability and accountability for variations in the pole 24 dimensions. For example, the fitting 22 of the preferred embodiment can accommodate a pole 24 having a cavity 23 width ranging from 3.558 to 3.932 inches. Preferably, the pole 24 is fabricated from suitable aluminum such as 356-T6 or an appropriate steel.

The thickness of the flange 20 is approximately 0.25 inches and the length of the fitting 22 below the flange 20 on the lower end of the mounting fixture 12 is 7 inches. The mounting fixture 12 is preferably fabricated from 356-T6 aluminum.

The depth of the lowermost portion of the groove 28 proximate the sidewall 36*a* of the tube as shown in FIGS. 3 and 4 in a presently preferred embodiment is 0.23 inches at 38. Progressing upwardly within the groove the depth decreases to 0.184 inches at 40, 0.138 inches at 42, 0.092 inches at 44, and 0.046 inches at 46. The pitch of the groove 28 in each threaded section 26 is 0.438 in a presently preferred embodiment.

A generally circular wire clip 50 is seated within each of the grooves 28 and may be installed in the groove 28 by the manufacturer prior to delivery of the mounting fixture 12 to the installation site. Each wire clip 50 includes a complete 360° arc and corresponding points 52*a*, 52*b* on the wire clip 50 between the 360° arc are spaced axially a distance 53 about 0.437 inches apart so that the wire clip 50 can be seated within the groove 28 having a compatible pitch. The outer diameter $D_0$ of the circle formed by the wire clip 50 is 3.50 inches and the diameter of the wire forming the circular clip 50 is 0.186 inches thick. Preferably, the gap 34 is less than the thickness of the clip wire and the wire clip 50 is elastic to expand and contract as will be described later herein.

Extending from the generally circular clip 50 are first and second ends 54 and 56, respectively. Ends 54 and 56 are generally straight and project preferably 1.75 inches from their tangent points 52*a*, 52*b*, respectively. Preferably, each end 54, 56 projects at an angle β with respect to a tangent T of the clip 50. The angle β is approximately 40° in a presently preferred embodiment. The purpose for this angle β will be described later herein. The transverse surface or face 54', 56' of each end 54, 56 of the wire clip 50 is generally planar and perpendicular, with respect to the longitudinal axis of the respective end (FIG. 4B).

Figure 3A:
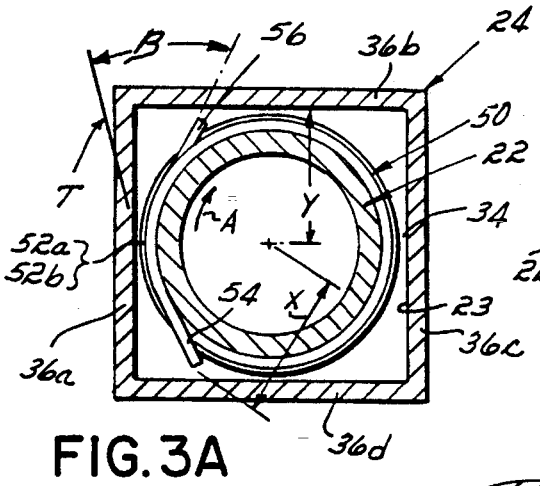

Prior to installation of the mounting fixture 12 in the pole 24, the wire clips 50 are seated within the deeper lower portions of the grooves 28 of each threaded section 26 as shown particularly in FIGS. 3 and 3A. The depth of the groove 28 at the lower portion of each threaded section 26 is sufficient to conceal the outermost edge of the wire clip 50 within the outer profile of the fitting 22. The combination of the diameter of the outer surface of the fitting, the depth of the groove and the diameter of the wire used to form the clip must be such that when the clip is proximate the lower end of its associated threaded section, the outer circumferential surface of the clip is slightly spaced inwardly from the inner surface or interior wall of the cavity defined by the hollow tubular pole, thereby permitting insertion of the fitting (with clip) into the cavity without mechanical interference between the clip and inner wall of the cavity.

Figure 4A:
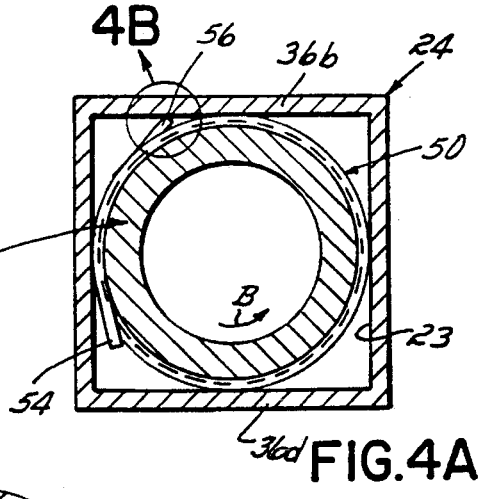

As such, the wire clip 50 does not initially contact the inner surface of the tubular pole 24 irrespective of variations in the nominal dimensions of the pole and other components. The flange 20 on the mounting fixture 12 rests upon the upper edge of the pole 24 after the mounting fixture 12 is inserted therein as shown in FIGS. 1, 3 and 4. To secure the mounting fixture 12 to the pole 24, the fitting 22 is rotated in the direction of arrow A so that the end wall 56' of wire end 56 of the wire clip 50 abuts against and engages the inner surface of the wall 36*b* of the tube as shown in FIGS. 4A and 4B. Preferably, a radial distance X from the first and second ends 54, 56 to a centerline axis of the fitting 22 and pole 24 is greater than a minimum radial distance Y from the centerline axis to the nearest inner surface of the pole 24. This relationship is preferred so that the ends 54, 56 engage the pole 24 inner surface upon rotation of the fitting 22 for installation and removal.

Figure 4B:
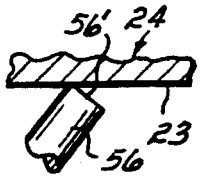
FIG. 4B is an enlarged view of the circular region 4B of FIG. 4A.

During securement, the planar face 56' of the end 56 engages the inner surface of the pole 24 and the clip 50 is prevented from continued rotation relative to the pole 24 (FIG. 4B). Further rotation of the fitting 22 thereby advances the wire clip 50 upwardly in the threaded section 26 and as such the clip 50 progresses from the deeper portion 38 of the groove toward the more shallow portions 46 of the groove 28 as previously described. As the clip 50 advances upwardly within the threaded section 26, it expands radially outwardly due to the tapered profile of the progressively decreasing depth of the groove 28. Expansion of the wire clip 50 forces it into contact with the inner surface of the pole 24 thereby forming a friction fit between the mounting fixture 12 and the pole 24 as the wire clip 50 expands and advances upwardly in the tapered spiral groove 28. The friction fit between the wire clip 50, fitting 22, and pole 24 prevents wobble and vibration between these components and offers a stable and secure connection between the mounting fixture 12 and luminaire assemblies 10 and the pole 24. Preferably, a clip 50 is seated within each of the two spaced grooves 28A and 28B to provide for multiple spaced contact points on each face of the inner pole cavity to minimize or eliminate wobble between the mounting fixture 12 and the pole 24. Tilt or wobble between the mounting fixture 12 and the pole 24 are potentially not eliminated if only one clip 50 is provided on the fitting 22; multiple points of contact with the pole 24 along the length of the fitting 22 with multiple clips 50 are presently preferred according to this invention.

It will be appreciated that instead of the clip ends 54 or 56, another type of detent on the clip 50 or other design to prevent rotation of the clip 50 is within the scope of this invention. For example, another embodiment of the invention is shown in FIG. 6 in which the clip 50*a* includes a radially extending tab 51. The clip 50*a* is seated within the groove 28 of the fitting 22 which for simplicity is not shown in FIG. 6 but would be included in this embodiment. The cavity 23 of a pole 24*c* includes a longitudinal slot 53 sized to receive therein the tab 51. During installation of the fitting and clip 50*a* into the cavity 23 the tab 51 must be aligned with the slot 53. Once the fitting and clip 50*a* thereon are inserted into the pole 24*c*, rotation of the fitting relative to the pole secures the fitting to the pole because the clip 50*a* is prevented from rotation relative to the pole 24*c* and expands in the groove of the fitting as previously described.

The ends 54, 56 of the wire clip are angled with respect to the tangent T at each point 52*a*, 52*b* on the wire clip 50. In a presently preferred embodiment, they are angled 40° with respect to the tangent T as shown in FIG. 3A. After the fitting 22 is rotated and the wire clips 50 form the friction fit between the mounting fixture 12 and the pole 24, the mounting fixture 12 may be rotated 40° in a preferred embodiment in a direction opposite to that of arrow A, to position the luminaire assemblies 10 and mounting fixture 12 as may be desired for proper illumination or aesthetically indicated. Rotation up to 40° in a direction opposite to arrow A will not loosen the friction fit because the first end 54 of the wire clip 50 has not contacted the sidewall 36*d* of the pole 24 until the 40° rotation is completed. The amount of rotation of the fitting 22 in the reverse direction after being tightened is a function of the angle β, the length of ends 54, 56 and the size of the cavity 23. Therefore, the friction fit is maintained because the clip 50 does not begin to travel downwardly in the threaded section 26 and contract until the first end 54 engages the pole 24. As a result, the luminaire assemblies 10 can be positioned preferably within a 40° range without loosening the connection between the mounting fixture 12 and the light pole 24 due to the angle β of the ends, 54, 56.

After the friction fit is achieved upon rotation in the direction of arrow A of the fitting 22, the installer preferably drills a hole 58 through the sidewall 36*c* of the pole 24 and into the middle section 30 of the fitting 22 and installs a locking pin 60, screw or other mechanical fastener therein to prevent continued rotation of the fitting relative to the pole 24. The locking pin 60 is tapped into the hole 58 with a hammer or the like (not shown).

If the mounting fixture 12 is to be removed from the pole 24 for repair, replacement or for other reasons, the locking pin 60 is first removed by tapping it inwardly through the hole 58 so that it falls through the hollow fitting 22 and down into the pole 24. The mounting fixture 12 is then rotated in a second direction as shown by arrow B in FIGS. 4 and 4A. Continued rotation of the fitting 22 forces the first end 54 of the wire clip 50 into engagement with the sidewall 36*d* of the square tubular pole 24 as shown in FIG. 4A thereby preventing rotation of the wire clip 50 relative to the pole 24. Continued rotation of the fitting 22 advances the clip 50 downwardly within the groove 28 toward the deeper portions of the groove 28 thereby contracting or restricting the wire clip 50 and releasing the friction fit. The fitting 22 is rotated until the wire clip 50 is seated within the lower and deeper portions of the groove 28 and out of contact with the inner surface of the pole 24. As a result, the mounting fixture 12 can then be lifted from the pole 24 for adjustment, replacement or the like and then reinserted as required and secured as previously described with rotation of the fitting 22 as shown in FIGS. 3 and 3A. Another locking pin 60 or fastener is then inserted into the hole 58 or a new hole (not shown) is drilled in the pole 24 and/or fitting 22.

Figure 5A:
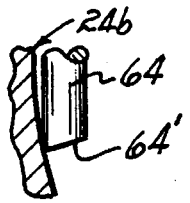
FIG. 5A is an enlarged view of the circular region 5A of FIG. 5.
Figure 5:
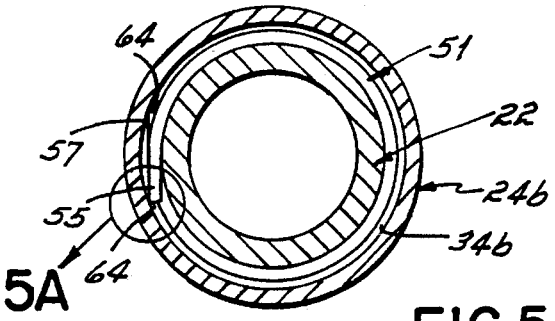
FIG. 5 is a cross-sectional view of an alternative embodiment of the pole and mounting fixture according to this invention showing a fitting inserted within a circular cross-section pole.

It will be appreciated by one of ordinary skill in the art that other configurations for the tubular pole 24 can be employed within the scope of this invention. Specifically, the pole 24 does not have to have an internal cross-section which is square as shown and described in a particularly preferred embodiment of the invention but may consist of any polygonal shape such as a triangle, pentagon, or the like or even an irregular shaped polygon. Furthermore, as shown in another presently preferred embodiment of the invention, the tubular pole 24*b* may have a circular internal cross-sectional configuration as shown in FIG. 5. The fitting 22 is similar to that previously described and a presently preferred embodiment of the circular pole 24*b* has an outer diameter of 4 inches, a wall thickness of 0.134 inches and an inner diameter of 3.732 inches thereby providing the gap 34*b* between the outer diameter of the fitting 22 and the inner surface of the circular pole 24*b*. Moreover, due to the design of the groove 28, the fitting 22 of a given size can accommodate a range of inner diameter circular poles 24*b* thereby accounting for manufacturing variations in the pole 24*b* and minimizing inventory for the installer.

In this preferred embodiment of the invention, alternate wire clips 51 are preferably snugly inserted within the pole 24*b* and the ends 55, 57 are shorter than in clip 50 and are tangent to the clip circumference. The clip 51 is within the groove 28 so that the fitting 22 and clips 51 may be inserted into the open upper end of the pole 24*b*. Each end 55, 57 of the clip 51 of this presently preferred embodiment preferably has a 15° angled face 64 with respect to each end 55 or 57 to enhance the frictional interaction between the end 55 or 57 and engagement of the inner surface of the pole 24*b*. As a result, the face 64 may dig into the inner surface of the pole 24*b* (FIG. 5A). Preferably, the ends 55, 57 overlap approximately 1 inch; however, it has been found that the clip 51 also works according to this invention if the ends 55 and 57 are spaced one from another a nominal amount in the as formed condition (i.e., not contracted to form friction fit). As a result, the fitting 22 may be secured and released from the pole 24*b* as previously described with reference to the first embodiment of the invention so that the clips 51 are prevented from rotating with the fitting 22 and thereby advancing toward the more shallow portions of the groove 28 to form a friction fit between the clip, fitting and pole.

From the above disclosure of the general principles of the present invention and the preceding detailed description of a preferred embodiment, those skilled in the art will readily comprehend the various modifications to which this invention is susceptible. For example, the clip of this invention could take a variety of forms of retainers or the like in addition to those shown and described herein and the fitting and clip of this invention could readily be used for a wide variety of connections involving tubular members in addition to the light mounting fixture application described and shown herein. Therefore, we desire to be limited only by the scope of the following claims and equivalents thereof.

We claim:

1. A method for assembling a light fixture comprising:

seating a generally circular clip having a first end within a spiral groove on a generally cylindrical fitting proximate a first end of said fitting, a depth of said groove increasing toward said first end;

inserting said fitting and said clip into a noncircular open end of a tubular pole;

engaging said clip first end with an inner surface of said pole to thereby inhibit rotation of said clip relative to said pole;

rotating said fitting in a first direction relative to said pole thereby advancing said clip within said groove away from said fitting first end, said clip expanding into a friction fit between said fitting and said pole as said clip advances in said groove away from said first end, wherein said clip accommodates a range of sizes of said open end while expanding into said friction fit; and attaching at least one luminaire assembly to said fitting.

2. The method of claim 1 further comprising:

inserting a fastener through a sidewall of said pole and into said fitting to prevent continued rotation of said fitting relative to said pole.

3. The method of claim 1 further comprising:

engaging a second end of said clip with said inner surface of said pole to thereby inhibit rotation of said clip in a second direction relative to said pole;

rotating said fitting relative to said pole in a second direction thereby advancing said clip toward said fitting first end, said clip contracting to release said friction fit and permit removal of said fitting from said pole;

re-inserting said fitting and said clip into said open end of said pole;

re-engaging said clip first end with said inner surface of said pole; and re-rotating said fitting in said first direction to expand said clip into said friction fit with said pole.

4. The method of claim 1 wherein said fitting is secured to said pole without the benefit of tools.

5. The method of claim 1 further comprising:

rotating said fitting relative to said pole in a second direction opposite said first direction through an arc wherein an orientation of said luminaire assembly is adjusted without releasing said friction fit.

6. The method of claim 1 further comprising:

seating a second generally circular clip having a first end within a second spiral groove on said generally cylindrical fitting similar to said spiral groove, said second clip being spaced from said clip;

engaging said second clip first end with said inner surface of said pole to thereby inhibit rotation of said second clip relative to said pole, whereby said second clip expands into a second friction fit with said pole so that said clip and said second clip in combination minimize axial misalignment between said fitting and said pole.

7. A pole-mounted light comprising:

a tubular pole having an inner surface defining a noncircular cavity which terminates at an open end;

a mounting fixture having a generally cylindrical fitting on a lower end thereof inserted into said cavity via said open end of said tubular pole, said fitting having an outer generally cylindrical surface provided with a spiral groove forming a threaded section symmetrically disposed about a longitudinal axis of said fitting, said groove having a depth with respect to said cylindrical fitting surface which gradually decreases along the axis of said fitting;

a retainer seated within said groove and having a detent;

wherein when said fitting is rotated in a first direction relative to said pole said detent engages said inner surface of said cavity to inhibit movement of said retainer relative to said pole so that continued rotation of said fitting advances said retainer along said groove and circumferentially expands said retainer within said groove to force said retainer into frictional engagement with said inner surface of said noncircular cavity over a range of sizes of said cavity to thereby secure said mounting fixture to said pole; and at least one luminaire attached to said mounting fixture.

8. The light of claim 7 further comprising:

a second detent on said retainer wherein when said fitting is rotated in a second direction opposite said first direction said second detent engages said inner surface of said noncircular cavity and continued rotation in said second direction contracts said retainer and releases said frictional engagement to permit removal of said mounting fixture from said pole and reuse of said mounting fixture in a similar said pole.

9. The light of claim 8 wherein said retainer is a generally circular clip having first and second ends corresponding to said first and second detents, respectively, and said first and second ends are each generally straight and extend generally perpendicular to a longitudinal axis of said pole at an acute angle with respect to a tangent of said generally circular clip so that once said mounting fixture is secured in said pole said fitting and said luminaire attached thereto can be rotated up to said angle in a second direction opposite said first direction without loosening said friction fit to thereby adjust an orientation of said luminaire.

10. The light of claim 7 further comprising:

a fastener adapted to be selectively inserted through a sidewall of said tubular pole and into said mounting fixture to prevent continued rotation of said mounting fixture relative to said pole when inserted therein.

11. The light of claim 8 further comprising:

a second retainer being similar to and spaced from said first retainer such that upon rotation of said mounting fixture in said first direction said retainer and said second retainer are each forced into frictional engagement with said inner surface of said noncircular cavity and said retainer and said second retainer being spaced combine to minimize axial misalignment between said fitting and said pole.

12. The light of claim 7 further comprising:

a second detent on said retainer, wherein initial rotation of said mounting fixture through an arc in a second direction opposite to said first direction does not loosen said friction fit, continued rotation past said arc engages said second detent with said pole inner surface to inhibit rotation of said retainer and advances said retainer downwardly in said groove and contracts said retainer within said groove to release said friction fit, wherein rotation of said fitting within said arc in said second direction allows for adjustment of said luminaire assembly without loosening said friction fit.

13. A light fixture comprising:

a tubular pole having a generally rectangular cross-sectional configuration at an open upper end thereof;

a mounting fixture having a generally cylindrical fitting on a lower end thereof inserted into said upper end of said tubular pole, said fitting having a groove in an outer surface thereof forming a threaded section, a depth of said groove with respect to an outer circumference of said fitting gradually decreasing upwardly along said fitting;

a gap between said mounting fixture and an inner surface of said pole;

a generally circular clip seated within said groove and having a first end and a second end, said clip having a thickness greater than said gap;

wherein when said fitting is rotated in a first direction relative to said pole said first end engages said inner surface of said pole to inhibit rotation of said clip so that continued rotation of said fitting advances said clip upwardly in said groove and expands said clip within said groove to force said clip into a friction fit between said pole inner surface and said fitting over a range of sizes of said pole to secure said fitting to said pole;

wherein initial rotation through an arc of said fitting in a second direction relative to said pole does not loosen said friction fit, continued rotation past said arc engages said second end with said pole inner surface to inhibit rotation of said clip and advances said clip downwardly in said groove and contracts said clip within said groove to release said clip from said friction fit to permit removal of said fitting from said pole;

a fastener adapted to be selectively inserted through a sidewall of said tubular pole and into said mounting fixture to prevent continued rotation of said mounting fixture relative to said pole when inserted therein; and at least one luminaire assembly attached to said mounting fixture, wherein rotation within said arc of said fitting in said second direction allows for adjustment of said luminaire assembly without loosening said friction fit.

14. The light fixture of claim 13 wherein said first end and said second end are each straight and extend at an acute angle with respect to a tangent of said generally circular clip and generally perpendicular to a longitudinal axis of said pole, said acute angle corresponding to said arc.

15. The light fixture of claim 13 further comprising:

a second fitting on said mounting fixture similar to said fitting and being spaced relative to said fitting; and a second clip on said second fitting, said second clip being similar to said first clip, wherein rotation of said mounting fixture in said first direction forces said second clip into a second friction fit and said friction fit and second friction fit combining to minimize axial misalignment between said fixture and said pole.

16. The light fixture of claim 13 wherein a radial dimension from said first end to an axis of said fitting is no less than a minimum distance from said axis to said pole inner surface.

17. A light fixture comprising:

a tubular pole having a generally circular cross-sectional configuration at an open upper end thereof;

a mounting fixture having a generally cylindrical fitting on a lower end thereof inserted into said upper end of said tubular pole, said fitting having a groove in an outer surface thereof forming a threaded section, a depth of said groove with respect to an outer circumference of said fitting gradually decreasing upwardly along said fitting;

a gap between said mounting fixture and an inner surface of said pole;

a generally circular clip seated within said groove and having first and second pointed ends, said clip having a thickness greater than said gap;

wherein when said fitting is rotated in a first direction relative to said pole said first pointed end engages an inner surface of said pole to inhibit rotation of said clip so that continued rotation of said fitting advances said clip upwardly in said groove and expands said clip within said groove to force said clip into a friction fit between said pole inner surface and said fitting over a range of sizes of said pole to secure said fitting to said pole;

wherein rotation of said fitting in a second direction relative to said pole engages said second pointed end with said pole inner surface to inhibit rotation of said clip so that continued rotation in said second direction advances said clip downwardly in said groove and contracts said clip within said groove to release said clip from said friction fit to permit removal of said fitting from said pole; and at least one luminaire assembly attached to said mounting fixture.

18. The light fixture of claim 17 further comprising:

a second fitting on said mounting fixture similar to said fitting and being spaced relative to said fitting; and a second clip on said second fitting, said second clip being similar to said clip, said second clip being forced into a second friction fit upon rotation of said fitting in said first direction, said clip and said second clip being spaced combine to minimize axial misalignment between said fitting and said pole.

19. The light fixture of claim 17 further comprising:

an arc through which initial rotation of said mounting fixture in said second direction does not loosen said friction fit and allows for adjustment of said luminaire assembly.

20. The light fixture of claim 17 further comprising:

a fastener adapted to be selectively inserted through a sidewall of said tubular pole and into said mounting fixture to prevent continued rotation of said mounting fixture relative to said pole when inserted therein.

* * * * *

UNITED STATES PATENT AND TRADEMARK OFFICE

CERTIFICATE OF CORRECTION

PATENT NO. : 5,599,094

DATED : February 4, 1997

INVENTOR(S) : Jerry F. Fischer, Robert E. Kaeser & James E. Lawrence

It is certified that error appears in the above-indentified patent and that said Letters Patent is hereby corrected as shown below:

Column 10, Line 10 "of claim 8" should read --of claim 7--.

Signed and Sealed this

Fifth Day of August, 1997

Bruce Lehman

*Attest:*

BRUCE LEHMAN

*Attesting Officer*

*Commissioner of Patents and Trademarks*